US007586514B1

(12) United States Patent
Salazar et al.

(10) Patent No.: US 7,586,514 B1
(45) Date of Patent: Sep. 8, 2009

(54) COMPACT REMOTE TACTICAL IMAGERY RELAY SYSTEM

(75) Inventors: Ronald M. Salazar, Ridgecrest, CA (US); James E. Wojciehowski, Ridgecrest, CA (US); Daniel W. Fagen, Inyokern, NY (US); Richard V. Hong, Ridgecrest, CA (US); Brad E. Metziner, Ridgecrest, CA (US); Steven J. Luhn, Inyokern, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 1039 days.

(21) Appl. No.: 11/021,901

(22) Filed: Dec. 15, 2004

(51) Int. Cl.
*H04N 7/18* (2006.01)

(52) U.S. Cl. ..... 348/144

(58) Field of Classification Search ..... 348/117, 348/144, 148

See application file for complete search history.

(56) References Cited

U.S. PATENT DOCUMENTS

| | | | | |
|---|---|---|---|---|
| 3,076,189 | A * | 1/1963 | Goddard George W | 342/52 |
| 3,076,961 | A * | 2/1963 | Bibbero Robert J | 342/53 |
| 5,077,609 | A * | 12/1991 | Manelphe | 348/144 |
| 5,844,602 | A * | 12/1998 | Lareau et al. | 348/144 |
| 5,894,323 | A * | 4/1999 | Kain et al. | 348/116 |
| 6,388,611 | B1 * | 5/2002 | Dillman | 342/357.06 |
| 6,477,326 | B1 * | 11/2002 | Partynski et al. | 396/7 |
| 7,302,323 | B2 * | 11/2007 | Anderson et al. | 701/35 |
| 2003/0090572 | A1 * | 5/2003 | Belz et al. | 348/207.1 |
| 2004/0233282 | A1 * | 11/2004 | Stavely et al. | 348/143 |

* cited by examiner

*Primary Examiner*—Tung Vo
*Assistant Examiner*—Anner Holder
(74) *Attorney, Agent, or Firm*—David S. Kalmbaugh

(57) ABSTRACT

An imagery system that transfers digital images of a target from a military aircraft to a ground station or other aircraft and returns an updated image to the aircraft for pursuit and destruction of the target. The imagery system includes a digital image processor that captures still images from weapons video supplied by a weapons video source on board the aircraft.

6 Claims, 7 Drawing Sheets

FTI II a
46
INTEGRATED REMOTE CONTROL UNIT (I-RCU)
54
52
56
48
MOUNTING PALLET
INTERFACE CABLE SET
58
36
38
34
60
20
46
56
58
60
CRTICS PALLET

SYSTEM CONNECTIONS

COMPACT REMOTE TACTICAL IMAGERY RELAY SYSTEM

BACKGROUND OF THE INVENTION

1. Field of the Invention

The present invention relates generally to military aircraft imagery systems. More particularly, the present invention relates to an imagery system that transfers digital imagery of a target from a military aircraft to a ground station or other aircraft and returns an updated image to the aircraft for pursuit and destruction of the target.

2. Description of the Prior Art

Currently multiple military platforms, including the F/A-18 aircraft, use a PhotoTelesis Fast Tactical Imagery device to capture frames of digital video from an aircraft's sensors. The images are compressed by an aircraft's electronics systems and sent to a ground station for review and additional processing. Upon receiving the compressed images, ground troops can confirm that the pilot is observing an actual enemy target and transmit bombing coordinates to the pilot. Further, the ground troops can determine if the target is actually friendly troops thereby preventing a "blue-on-blue" or friendly fire incident.

The Fast Tactical Imagery device includes two weapon replaceable assemblies. The first assembly is a PRISM device, which is located in the avionics bay of the aircraft. The PRISM device performs the compression-decompression of the image and interfaces with the aircraft radios. The second assembly is the Remote Control Unit (RCU), which is mounted in the aircraft cockpit. The aircraft's pilot uses the RCU to control the PRISM device.

There is currently a need to deploy the PhotoTelesis Fast Tactical Imagery device on board the AV-8B Harrier aircraft. To install the Fast Tactical Imagery device on board the Harrier aircraft for use with the RCU would require installing approximately 23 new wires between the aircraft's cockpit and the aft avionics bay for the aircraft. This installation requires removal of an aircraft wing and engine, which would be an arduous task for one aircraft. For the entire fleet of Harrier aircraft the cost of outfitting each aircraft is prohibitive task.

Accordingly, there is a need to develop a system that uses existing aircraft cockpit displays and controls to operate the PRISM device.

SUMMARY OF THE INVENTION

The present invention overcomes some of the difficulties of the past including those mentioned above in that it comprises a highly effective compact remote tactical imagery relay system which utilizes existing serial data links and avionics on board the AV-8B harrier aircraft to capture still images from weapons video and then transmit the still images to a ground station for processing. The images can be annotated at the ground station and retransmitted to the aircraft for viewing by the pilot.

The compact remote tactical imagery transfer system comprising the present invention uses a Fast Tactical Imagery Processor, which is a digital image processor, to capture still images from weapons video supplied by a Litening pod or other weapons video source on board the AV-8B Harrier aircraft. The Fast Tactical Image Processor also provides for data compression, transmission, reception and display in the cockpit. An Integrated Remote Control Unit (IRCU) interfaces with the existing aircraft cockpit controls allowing the aircraft's pilot to control the operation of the Fast Tactical Imagery System and select still images for transfer to the ground station. The aircraft's on board encryption unit encrypts the still images and the onboard radio then transmits the still images to a ground station.

Observers at the ground station analyze the images using a laptop computer. The observers confirm the targets and coordinates are embedded in the still images, which are transmitted back to the aircraft for display to the pilot by display computer.

DETAILED DESCRIPTION OF A PREFERRED EMBODIMENT

Figure 1:
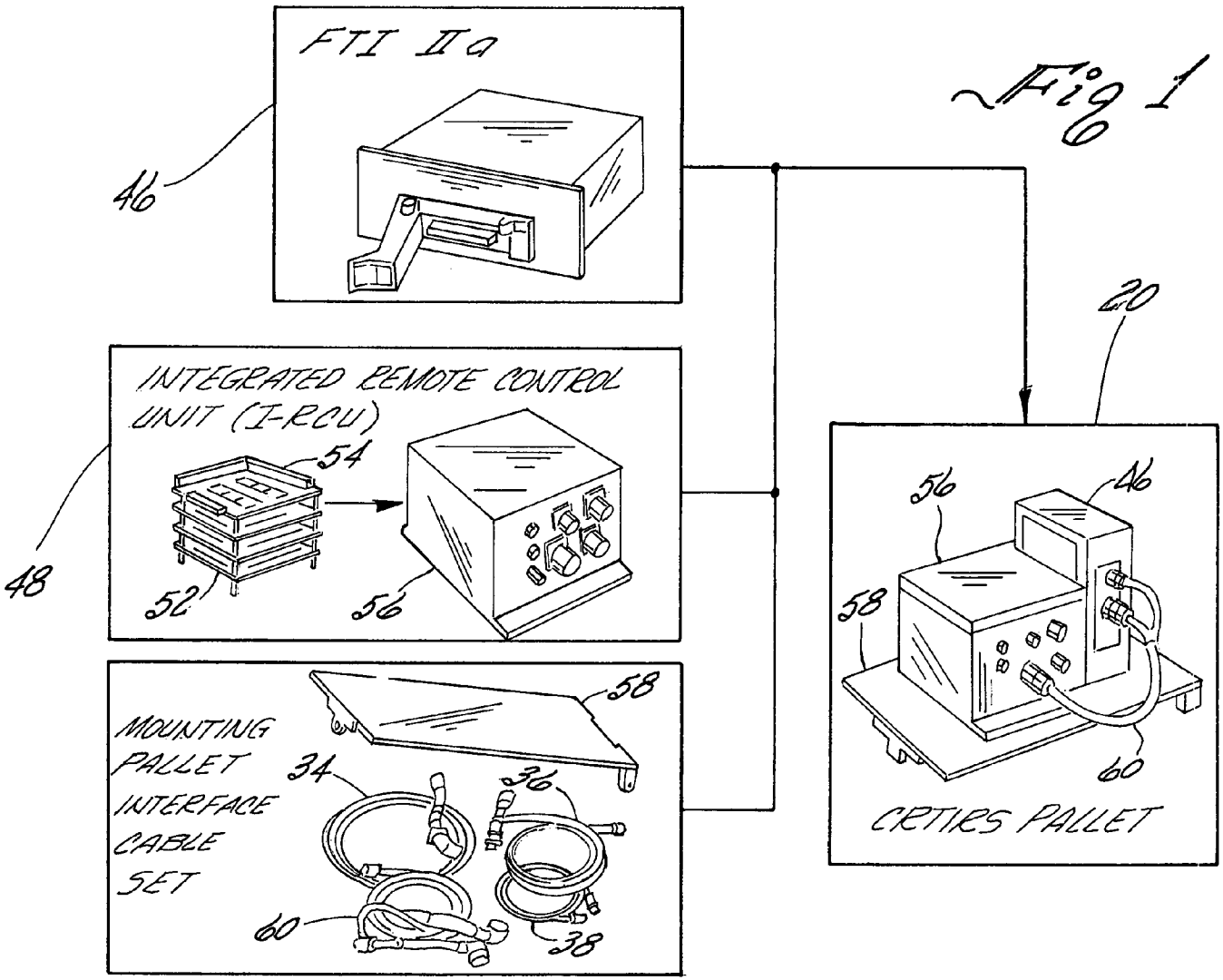
FIG. 1 is a block diagram illustrating the Compact Remote Tactical Imagery Relay System components.
Figure 2:
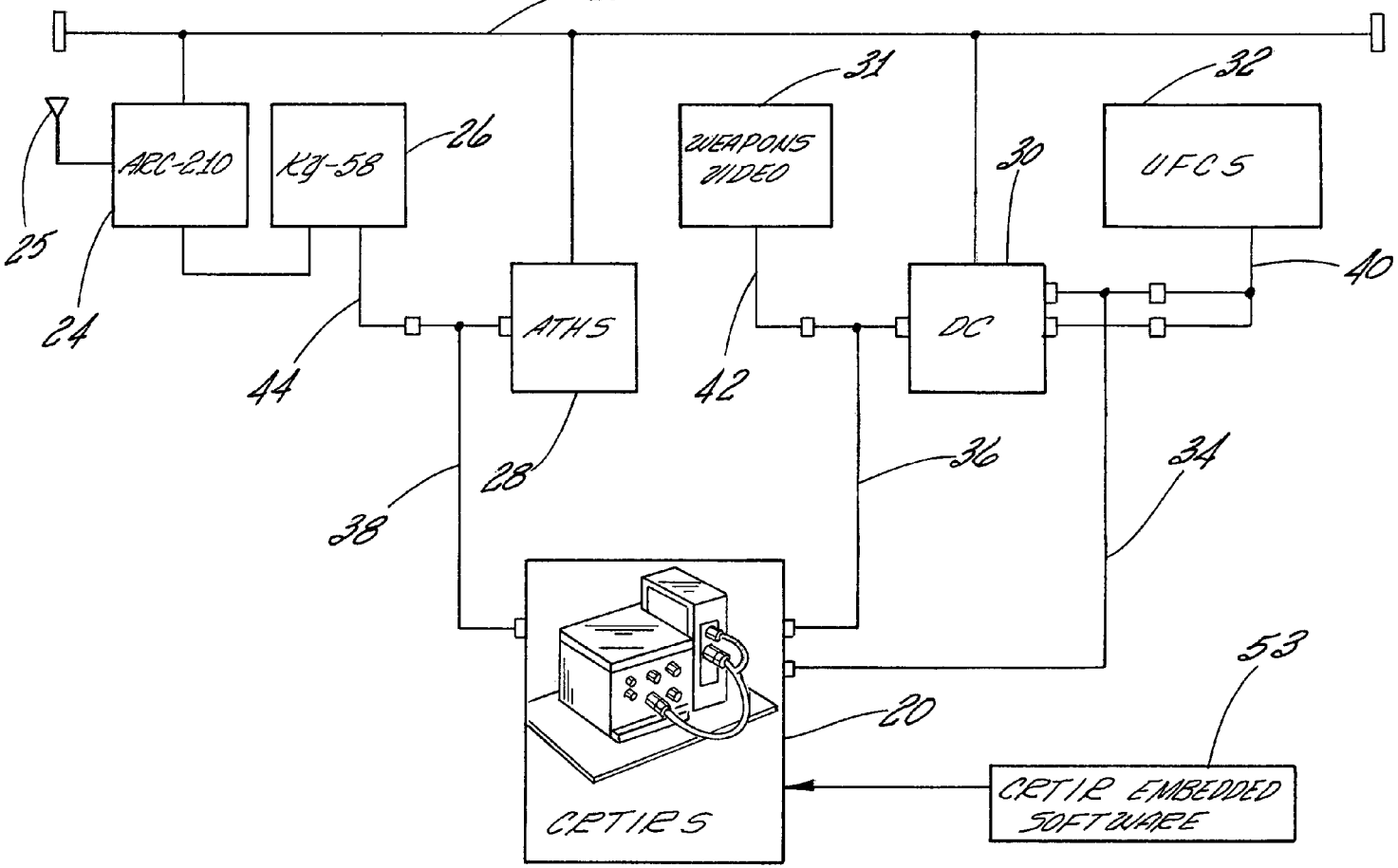
FIG. 2 is a block diagram illustrating the integration of the Compact Remote Tactical Imagery Relay System into the AV-8B Aircraft's existing serial data links.
Figure 3:
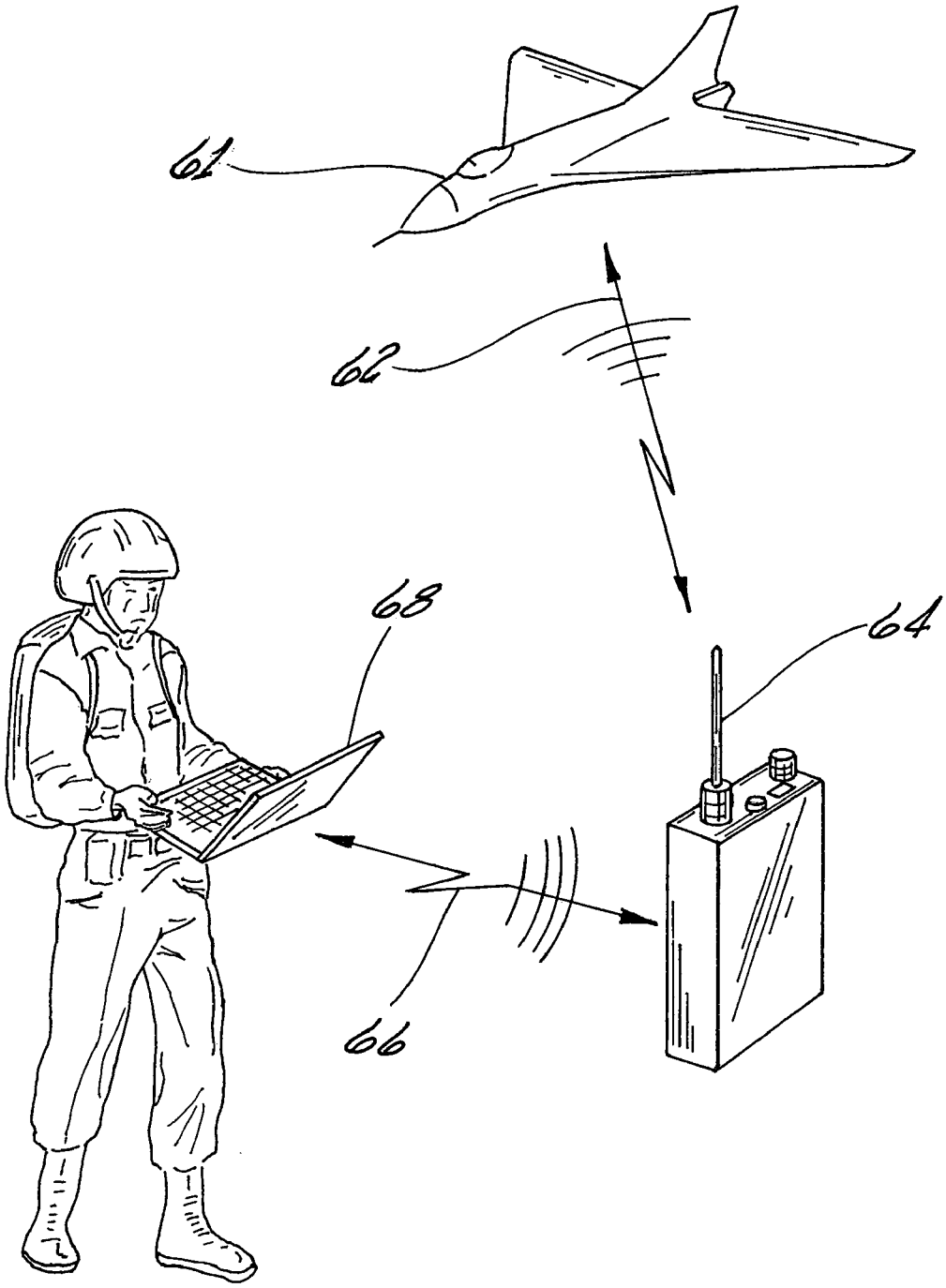
FIG. 3 is a pictorial representation of the Compact Remote Tactical Imagery Relay System in an operational environment.
Figure 4A:
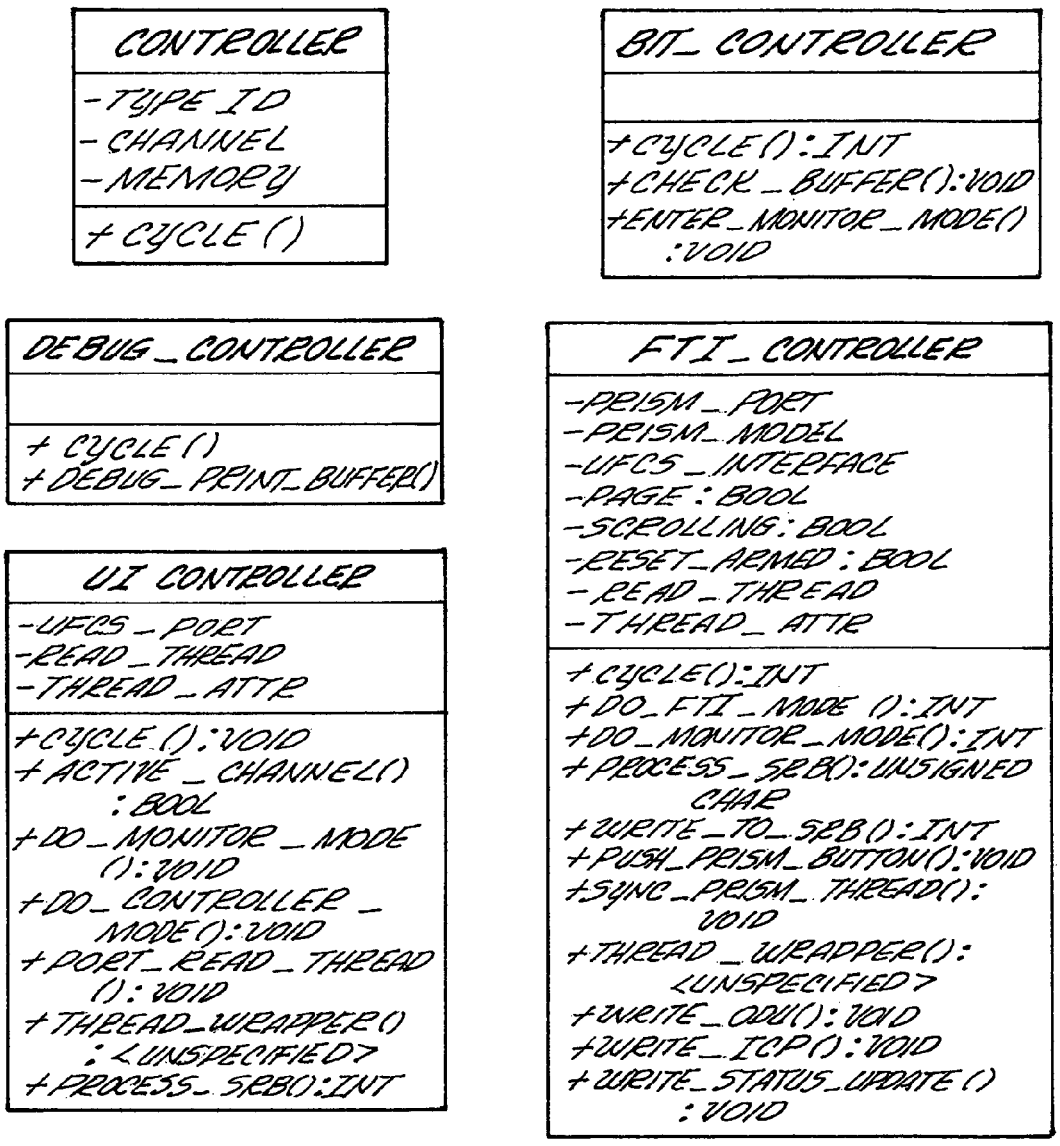
FIGS. 4A, 4B, 4C, 4D, 5 and 6 are software charts illustrating the computer software program for the Integrated Remote Control Unit component of the Compact Remote Tactical Imagery Relay System of FIG. 1.
Figure 4B:
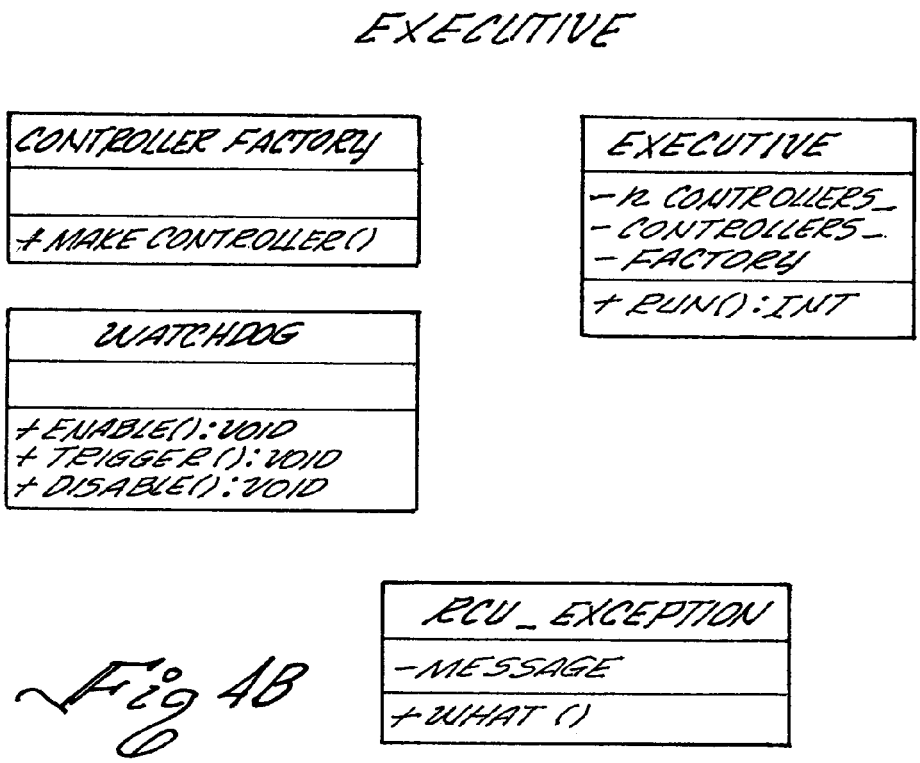
Figure 4C:
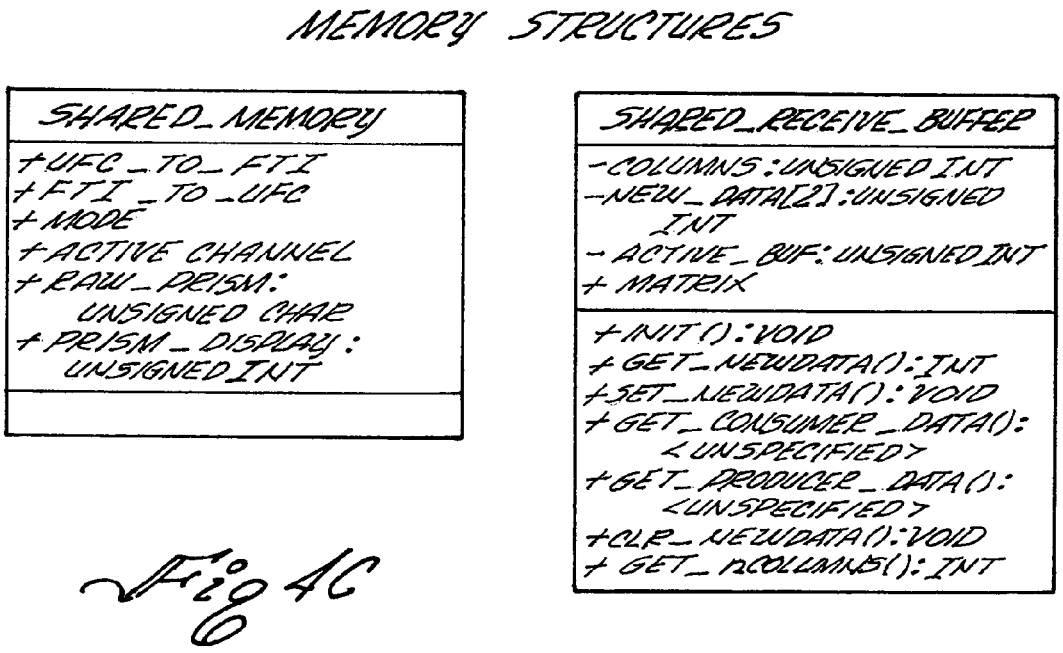
Figure 4D:
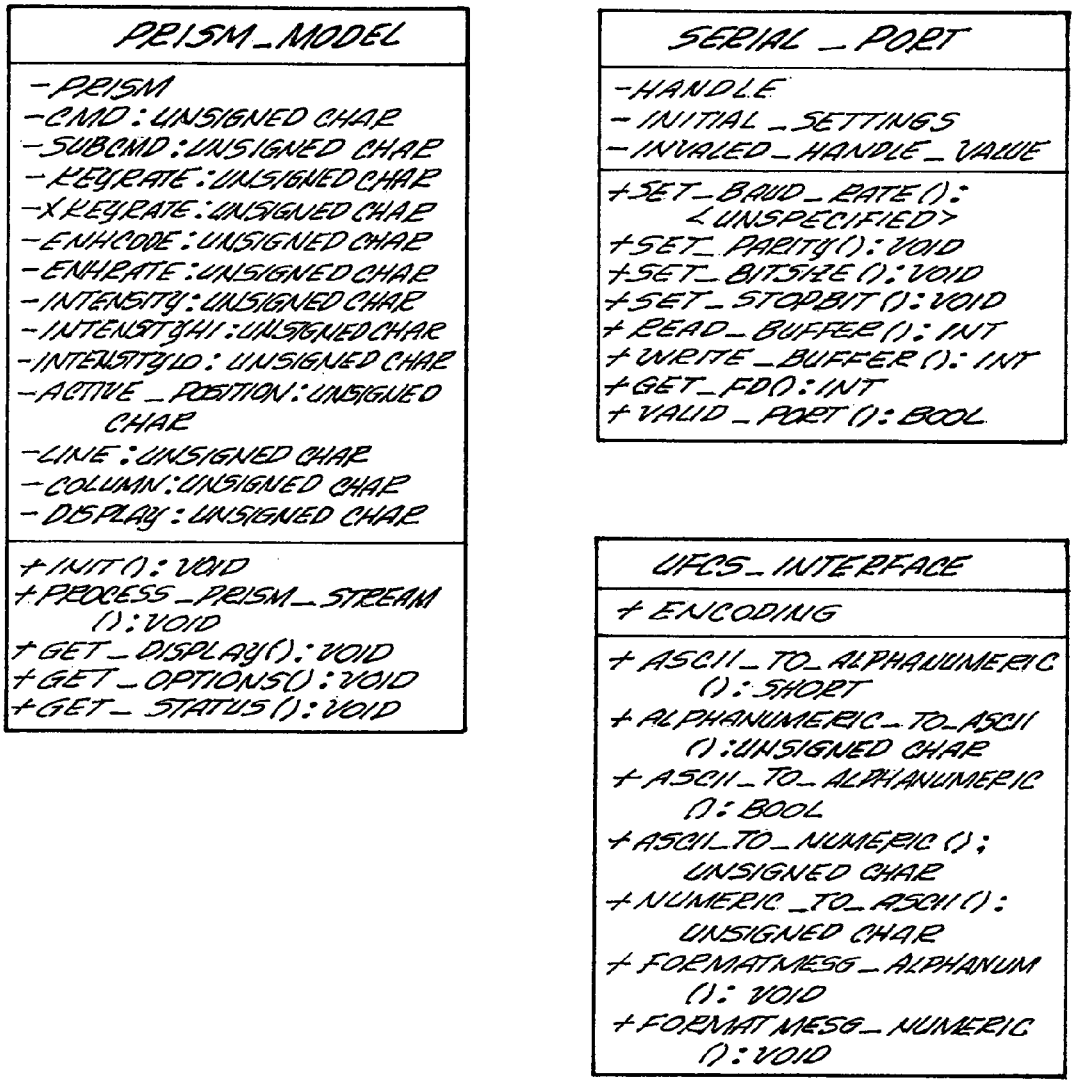

Referring to FIGS. 1, 2 and 3, there is shown in FIG. 2 the integration of Compact Remote Tactical Imagery Relay System 20 into the AV-8B Harrier aircraft 61. Connected to data bus 22 is an ARC-210 radio 24, which is a jam resistant two-way voice and data communications link to a ground station. Radio 24 includes an antenna 25 for transmitting image data to and receiving image data from the ground station or other military aircraft. Connected to the ARC-210 radio 24 is a KY-58 voice security device/encryption unit 26, which provides for secure communication between the aircraft and the ground station by encrypting image data transmitted to a ground station and decrypting image data received from the ground station.

There is also an Automatic Target Handoff System (ATHS) 28 connected to the Military Standard 1553 data bus 22. The Automatic Target Handoff System 28 is an integral component of the target acquisition data transmission capabilities of the AV-8B Harrier Aircraft 61. Target information is transferred using short data burst rather than voice communications to minimize the possibility of jamming and lessen the probability of detection, while increasing the transfer of very accurate target information.

The Radar Display Computer (DC) 30 is connected to the Military Standard 1553 data bus 22. The display computer 30 is also connected to a weapons video source 31. The AV-8B Harrier aircraft's video source utilized by the Compact Remote Tactical Imagery System 20 is a Litening pod 31 which is a targeting pod integrated into the aircraft's avionics and mounted externally to the aircraft. The target pod 31 contains a high resolution, forward looking infrared sensor that displays an infrared image of the target to the aircrew. The Litening pod 31 also contains a charged coupled device camera used to obtain target imagery in the visible portion of the electromagnetic spectrum.

An Up Front Control Set (UFCS) 32 located in the aircraft's cockpit is also connected to the radar display computer 30. The Compact Remote Tactical Imagery Relay System 20 includes a splitter cable 34 to interrupt the radar display computer 30 serial data connection/serial data line 40 to the Up Front Control Set 32, and a splitter cable 36 to interrupt the radar display computer 30 video connection/video data line 42 from Litening pod 31 which provides the weapons video to display computer 30. The Compact Remote Tactical Imagery Relay System 20 also has a splitter cable 38 to interrupt serial data connection 44 from the automatic target handoff system 28 which provides digital data and push to talk signals to the encryption unit 26.

As shown in FIG. 1, the Compact Remote Tactical Imagery Relay System 20 comprises a PhotoTelesis Fast Tactical Imagery IIa (FTI IIa) processor 46, which is a digital image processor providing for image capture from the weapons video supplied by the Litening pod 31. The FTI IIa processor 46 also provides for data compression, transmission, reception and display in the cockpit. In a reconnaissance scenario, the FTI IIa processor 46 supplies to the pilot time critical image strike information that allows the pilot to view a battlefield at extended ranges thru still frames. Bomb damage assessment can also be transmitted immediately after an air strike to the pilot.

Fast Track Imagery IIa processor 46 also has a compact flash memory card which is removable. The compact flash memory card provides a capability to upload and download target images before and after a mission. Small text messages may also be attached to and transmitted with the images, which are then displayed on a cockpit display via the display computer 30.

Compact Remote Tactical Imagery Relay System 20 also contains an Integrated Remote Control Unit (I-RCU) 48 which replaces a Remote Control Unit (RCU) normally used to control the operation of the Fast Tactical Imagery IIa processor 46. Integrated Remote Control Unit 48 monitors the Up Front Control Set 32 to Remote Display Computer serial bus by tapping connection 40 between display computer 30 and control set 32 to detect a switchover request. When a switchover request is detected by the Integrated Remote Control Unit 48, unit 48 replaces the display computer 30 for UFCS/display commands entered by the pilot. This allows for control of the digital image processor 46 by the pilot for digital imaging purposes.

When the Integrated Remote Control Unit 48 gains control of the Up Front Control Set 32, display computer 30 is disconnected from up front control set 32 and commands sent from push buttons on control set 32 are routed to the Integrated Remote Control Unit 48 for processing.

When image capture and transmission is not selected by the pilot, the Integrated Remote Control Unit 34 is in an unintrusive monitoring state. Further, removal of power from the Integrated Remote Control Unit 48 will result in normal communications between the remote display computer 30 and the up front control set 32.

Integrated remote control unit 48 comprises a commercially available PC104 processor board 52 and its associated I/O modules and power board 54 are stacked and then placed inside of the FTI IIa enclosure 56. The Integrated Remote Control Unit 48 and the FTI IIa enclosure 56 are mounted on a pallet 58 adjacent one another. A cable 60 connects the PC104 processor board 52 and its associated I/O modules and power board 54 to the FTI IIa processor 46.

The computer software program 53 for processor board 52 is written C++ and uses the Linux operating system.

Referring to FIGS. 1, 2 and 3, a pilot in an AV-8B Harrier aircraft 61 uses the Litening-II targeting pod 31 to observe ground target areas including specific targets such enemy troops, radar installation, and/or missile sites. The pilot of aircraft 61 snaps one or more images from the video stream he is watching via the radar display computer 30. The still images selected by the pilot are transmitted to a ground station via the aircraft's radio 24 as RF signals 62 which include compressed and encrypted video images.

At the ground station, a PRC-117 radio 64 with a built-in encryption unit receives the RF signals including the video images. The video images are decrypted and transmitted to a portable laptop computer 68 via a serial data link 66. Laptop computer 68 uses PhotoTelesis ICE software to process the video images for display at the ground station. ICE software is an integrated software application that provides capabilities to capture, display, compress, send and receive digital imagery on Windows computers. In addition, ICE software allows a user to manage, manipulate, annotate and print the still images. PhotoTelesis Corporation of San Antonio, Tex. manufactures the ICE software and the Fast Track Imagery IIa processor 46.

A PRC-113 radio with a KY-57 encryption unit can also be used at the ground station to receive and transmit video images to aircraft 61.

At the ground station, observers analyze the images using laptop computer 68. The observers confirm the targets and coordinates are embedded in the images that are transmitted back to the aircraft for display to the pilot by display computer 30. Image transfer time is approximately twenty seconds at nominal compression ratios.

Since the Compact Remote Tactical Imagery Relay System 20 uses existing aircraft avionics including radio 24, airframe structural modifications and electrical modifications are not required. System 20 can be installed in an aircraft and removed from the aircraft in less than three hours.

The CRTIR (Compact Rapid Tactical Imagery Relay) system software is written in object-oriented C++, with threads, and implemented on the Linux operating system.

Software control flow is based on the cyclic executive model. The main function dynamically creates all needed controllers using the controller data structure and input from the command line. It then cycles thru each of the controllers and allows them a turn at system resources. This is necessary to mimic the timing on the serial data link between the UFCS (Up Front Control System) and DCU (Display Computer Unit), which reside on the actual plane.

Software data flow is provided by the use of threads and a data blackboard. Data from the FTI PRISM and the UFCS is gathered via separate threads of execution and then written to a common memory area or blackboard which makes it available to the main thread of execution. The main thread of execution is responsible for writing out updates to the blackboard which are then forwarded to the UFCS and the FTI PRISM.

Integration of the PC 104 watchdog timer routines (FIG. 4) in the embedded software ensures program malfunction does not lock up the entire system.

FIGS. 4A, 4B, 4C, 4D, 5 and 6 are software charts illustrating the computer software program for the integrated remote control unit 46 of the Compact Remote Tactical Imagery Relay System 20 of FIG. 1.

FIGS. 4A, 4B, 4C and 4D is a top level view of the software elements grouped by function. The Controller software elements of FIG. 4A comprise Controller, BIT_Controller, Debug_Controller, FTI_Controller and Relay_Controller. The Executive software elements of FIG. 4B comprise Controller Factory, Executive and Watchdog. There is also an RCU_Exception element. The Memory Structures software elements of FIG. 4C comprise Shared_Memory and Shared_Receive_Buffer. The System Connections Software elements of FIG. 4D Comprise Prism_Model, Serial_Port, and UFCS_Interface.

Figure 5:
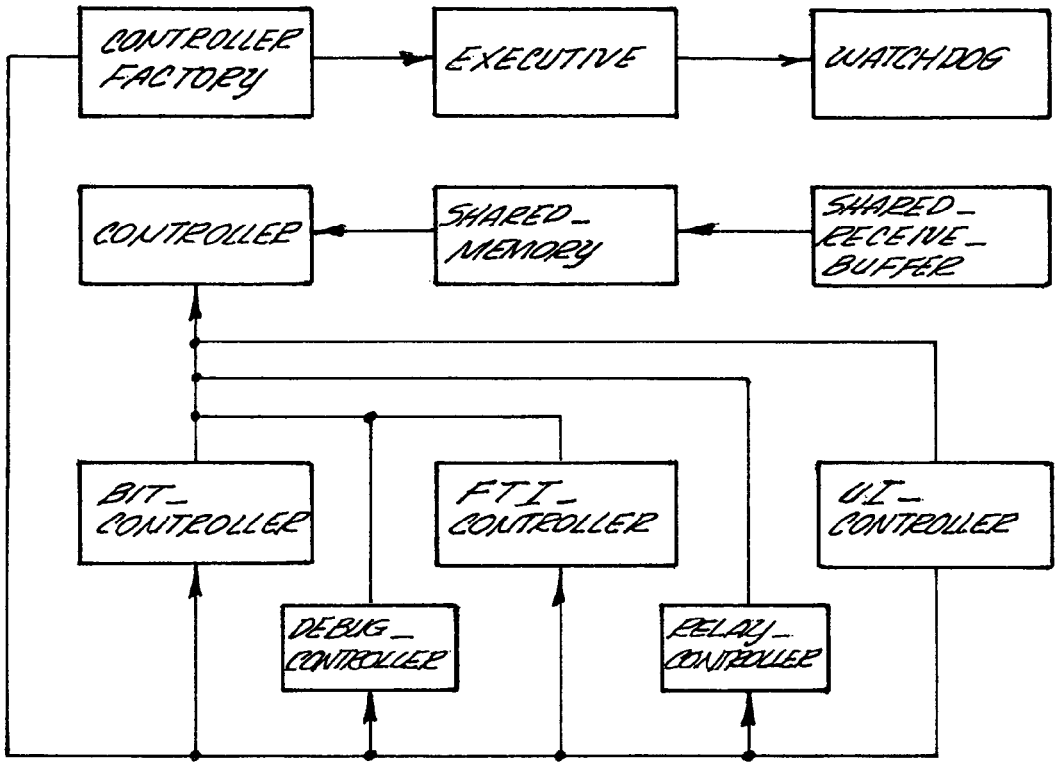

FIG. 5 depicts the relationship between various software object classes and the data contained in each class.

Figure 6:
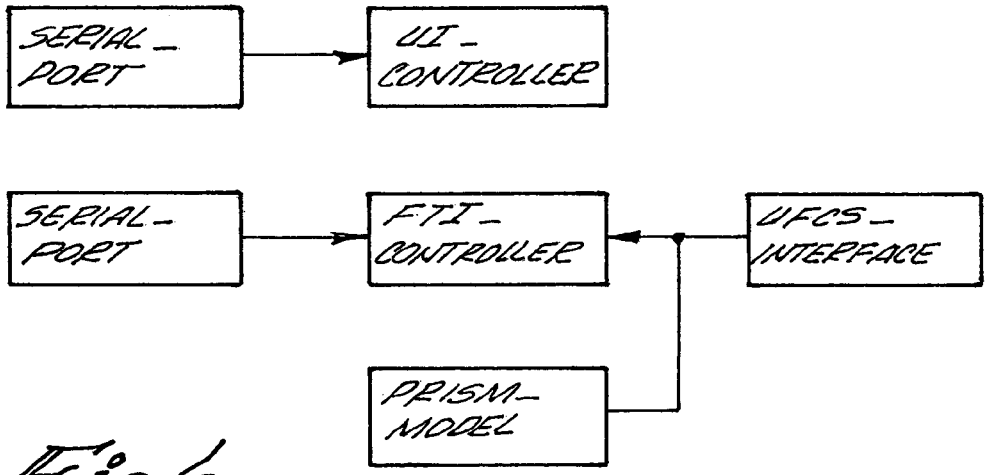

FIG. 6 depicts a more detailed view of the derived objects within the software system.

From the foregoing, it is readily apparent that the present invention comprises a new, unique, and exceedingly useful compact remote tactical imagery relay system for processing video images generated by an aircraft's weapons video source which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. An imagery system for transferring digital images of a target from an aircraft having cockpit controls to a video image processing station comprising:

a video source mounted on said aircraft, said video source including a charged coupled device camera to obtain target imagery of a battlefield scene including said target in a visible portion of an electromagnetic spectrum, said video source generating a weapons video of said battlefield scene and said target;

a digital image processor connected to said video source to receive said weapons video, said digital image processor providing for capture of still images of said target from the weapons video generated by video source, said digital image processor providing for data compression of the still images of said target prior to transmission of the still images of said target to said video image processing station;

a display computer connected to said digital image processor to receive the still images of said target, said display computer providing for a display of the still images of said target to a pilot of said aircraft;

an up front control set located in a cockpit of said aircraft and connected to said display computer, said up front control set allowing the pilot of said aircraft to enter display commands to control the display of the still images of said target by said display computer; and an integrated remote control unit connected to said up front control set and said digital image processor, said integrated remote control unit interfacing with the cockpit controls for said aircraft allowing the pilot for said aircraft to use the cockpit controls to control an operation of said digital image processor and select the still images of said target for transfer a second radio transmitter/receiver located at said video image processing station, said second radio transmitter/receiver receiving said RF signal, said second radio transmitter/receiver having an encryption unit which decrypts the still images of said target;

a laptop computer which includes a serial data link for connecting said laptop computer to said second radio transmitter/receiver, said laptop computer including software which allows a user to manage, manipulate, annotate and print the still images of said target prior to the still images of said target being retransmitted to said aircraft for viewing by the pilot of said aircraft, wherein observers at said video image processing station analyze the still images of said target using said laptop computer, said observers confirming the still images of said target and confirming that coordinates for said target are embedded in the still images of said target that are transmitted back to said aircraft for display to the pilot of said aircraft by said display computer an image transfer time for transmitting the still images of said target to said aircraft being approximately twenty seconds at nominal data compression ratios; and an automatic target handoff system connected to said encryption unit, said automatic target handoff system being adapted to minimize jamming and lessen a probability of detection of said RF signal, while increasing a transfer of accurate target information, wherein said transfer of accurate target information occurs using short data burst as opposed to voice communications to minimize a possibility of jamming and lessen a probability of detection, while increasing the transfer of accurate target information.

2. The imagery system of claim 1 wherein said video source comprises a target pod consisting of said charged coupled device camera, and a high resolution, forward looking infrared sensor that displays an infrared image of said target to an aircrew for said aircraft.

3. The imagery system of claim 1 wherein said digital image processor includes a flash memory card which is removable from said digital image processor, said flash memory card providing a capability for uploading and downloading the still images of said target before and after a mission.

4. The imagery system of claim 1 wherein said digital image processor allows text messages to be attached to the still images of said target, said text messages being displayed with the display of the still images of said target to said pilot.

5. The imagery system of claim 1 further comprising:

a first splitter cable, said first splitter cable having end connected to a serial data line connecting said display computer to said up front control set and an opposite end connected to said integrated remote control unit;

a second splitter cable, said second splitter cable having end connected to a video data line connecting said display computer to said video source and an opposite end connected to said digital image processor; and a third splitter cable, said third splitter cable having one end connected to said encryption unit and an opposite end connected to said digital image processor.

6. The imagery system of claim 1 wherein said integrated remote control unit and said digital image processor are mounted on a pallet adjacent one another, said integrated remote control unit and said digital image processor being connected to one another by an electrical cable.

* * * * *